US010539355B2

(12) United States Patent
Jeong et al.

(10) Patent No.: US 10,539,355 B2
(45) Date of Patent: Jan. 21, 2020

(54) ICE MAKER AND REFRIGERATOR HAVING THE SAME

(71) Applicant: Samsung Electronics Co., Ltd., Suwon-si, Gyeonggi-do (KR)

(72) Inventors: Jin Jeong, Yongin-si (KR); Do Yun Jang, Suwon-si (KR); Bong Su Son, Cheonan-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 116 days.

(21) Appl. No.: 15/626,695

(22) Filed: Jun. 19, 2017

(65) Prior Publication Data

US 2018/0017307 A1 Jan. 18, 2018

(30) Foreign Application Priority Data

Jul. 13, 2016 (KR) ..... 10-2016-0088691

(51) Int. Cl.

| | |
|---|---|
| ***F25C 1/18*** | (2006.01) |
| ***F25C 1/24*** | (2018.01) |
| ***F25C 5/04*** | (2006.01) |

(52) U.S. Cl.

CPC ..... *F25C 1/18* (2013.01); *F25C 1/24* (2013.01); *F25C 5/04* (2013.01); *F25C 2400/10* (2013.01); *F25C 2600/04* (2013.01); *F25C 2700/12* (2013.01)

(58) Field of Classification Search

CPC ..... F25C 1/18; F25C 1/10; F25C 1/22; F25C 1/24; F25C 5/04; F25C 5/18; F25C 5/182; F25C 2305/022; F25C 2400/10; F25C 2600/04; F25C 2700/12; F25C 2700/06

See application file for complete search history.

(56) References Cited

U.S. PATENT DOCUMENTS

| | | | | |
|---|---|---|---|---|
| 2,063,208 A | | 12/1936 | Tweedale | |
| 2,438,466 A | | 3/1948 | Tobey | |
| 6,148,624 A | * | 11/2000 | Bishop | F25C 5/185 62/137 |

(Continued)

FOREIGN PATENT DOCUMENTS

| | | |
|---|---|---|
| CN | 101520260 A | 9/2009 |
| CN | 100582613 C | 1/2010 |

(Continued)

OTHER PUBLICATIONS

Australian Notice of Acceptance dated Aug. 16, 2018, issued in Australian Application No. 2017204478.

(Continued)

*Primary Examiner* — Ljiljana V. Ciric

(74) *Attorney, Agent, or Firm* — Jefferson IP Law, LLP

(57) ABSTRACT

A refrigerator includes a main body having a storage compartment, and an ice maker provided in the storage compartment to make ice. The ice maker includes a cooling device to provide cold air, an ice-making tray movably provided between a first position adjacent to the cooling device and a second position spaced farther from the cooling device than the first position, and an ejector is configured to move the ice-making tray. The ejector includes a driving portion to separate the ice produced in the ice-making tray.

20 Claims, 11 Drawing Sheets

(56) References Cited

U.S. PATENT DOCUMENTS

| | | | | |
|---|---|---|---|---|
| 8,402,783 | B2 * | 3/2013 | Kim | F25C 1/08 62/139 |
| 8,408,016 | B2 * | 4/2013 | McCollough | F25C 5/04 62/135 |
| 9,448,003 | B2 * | 9/2016 | Shin | F25C 1/24 |
| 2007/0137241 | A1 * | 6/2007 | Lee | F25C 5/187 62/340 |
| 2011/0185760 | A1 * | 8/2011 | Suh | F25B 5/00 62/344 |
| 2011/0192175 | A1 | 8/2011 | Kuratani et al. | |
| 2017/0089629 | A1 * | 3/2017 | Ji | F25C 1/24 |

FOREIGN PATENT DOCUMENTS

| | | | |
|---|---|---|---|
| CN | 103026152 | A | 4/2013 |
| EP | 1 416 240 | A2 | 5/2004 |
| JP | H06-011219 | A | 1/1994 |
| JP | H08-54164 | A | 2/1996 |
| JP | H08-094223 | A | 4/1996 |
| JP | 2001-355945 | A | 12/2001 |
| JP | 2001355945 | A | 12/2001 |
| KR | 10-2015-0097225 | A | 8/2015 |

OTHER PUBLICATIONS

Chinese Office Action dated Jul. 1, 2019, issued in a counterpart Chinese application No. 201710569196.X.

* cited by examiner

ICE MAKER AND REFRIGERATOR HAVING THE SAME

CROSS-REFERENCE TO RELATED APPLICATION

This application claims the benefit under 35 U.S.C. § 119(a) of a Korean patent application filed on Jul. 13, 2016 in the Korean Intellectual Property Office and assigned Serial number 10-2016-0088691, the entire disclosure of which is hereby incorporated by reference.

TECHNICAL FIELD

The present disclosure relates to an ice maker and a refrigerator having the same. More particularly, the present disclosure relates to an ice maker and a refrigerator having the same capable of forming various kinds of ice.

BACKGROUND

Generally, a refrigerator is a device that keeps food fresh by having a storage compartment and a cooling air supply device that supplies cool air to the storage compartment. The refrigerator may also have an ice making chamber and an ice maker to generate ice.

An automatic ice maker generally includes an ice-making tray for storing ice-making water, an ejector for separating the ice from the ice-making tray, and an ice bucket for storing the ice separated from the ice-making tray.

Among ice-making systems for cooling ice making water, a direct cooling system is configured to have a refrigerant tube that extends into the ice making chamber to cool the ice-making water and contacts the ice making tray. In the direct cooling system, the ice-making tray receives cooling energy from the refrigerant tube in a thermally conductive manner. Therefore, the direct cooling system has an advantage in that the cooling rate of the ice-making water is relatively fast, but also has a drawback in that it produces non-transparent and misty ice.

In order to solve this problem, recently, a method has been proposed, in which a heater is applied on the bottom of the ice-making tray to grow ice in one direction to facilitate the air inside the ice-making water to dissipate to produce transparent ice, or another method has been proposed, in which crystals are grown to have a layer by layer form by setting the temperature of the ice making chamber to 0° C. or higher to remove the air inside the ice making water to produce transparent ice.

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above-mentioned problems and/or disadvantages and to provide at least the advantages described below. Accordingly, an aspect of the present disclosure is to provide an ice maker and a refrigerator having the same capable of controlling the speed of ice making.

Another aspect of the present disclosure is to provide an ice maker and refrigerator having the same, which operates in a rapid ice-making mode or a transparent ice-making mode according to a user's selection.

Another aspect of the present disclosure is to provide an ice maker and refrigerator having the same, which changes a distance between an ice-making tray and a cooling device using existing components.

In accordance with an aspect of the present disclosure, a refrigerator is provided. The refrigerator includes a main body having a storage compartment, and an ice maker provided in the storage compartment configured to make ice, wherein the ice maker includes a cooling device configured to provide cold air, an ice-making tray movably arranged provided between a first position adjacent to the cooling device and a second position spaced farther from the cooling device than the first position, and an ejector configured to move the ice-making tray, the ejector including a driving portion configured to separate the ice produced in the ice-making tray.

The ice maker may be operated in a first ice-making mode when the ice-making tray is in the first position, and operated in a second ice-making mode, in which an ice-making speed is slower than that of first ice-making mode, when the ice-making tray is in the second position.

The ice-making tray may include a rotation guide portion that is in contact with a portion of the driving portion, and the driving portion may be configured to be slidingly rotated on one surface of the rotation guide portion.

The driving portion may be provided at both ends portion of the ejector and has an eccentric shape.

The driving portion may be configured to move the ice-making tray to a first position adjacent to the cooling device when the driving portion is rotated a first angle such that a first portion adjacent to the rotation center is in contact with the rotation guide portion, and the driving portion may be configured to move the ice-making tray to a second position spaced apart from the cooling device when the driving portion is rotated a second angle such that a second portion spaced from the rotation center is in contact with the rotation guide portion.

The refrigerator may further include a supporter to support the ice-making tray and fix the ejector to be rotatable.

The refrigerator may further include a temperature sensor arranged to measure an inside temperature of the ice-making tray, wherein the supporter may include a temperature sensor fixing portion configured to fix the temperature sensor.

The supporter may include a drain hole formed in a portion where the driving portion is disposed.

The supporter may include a guide portion configured to guide movement of the ice-making tray.

The supporter may include a first supporter provided on one side of the ice-making tray and having a first ejector support portion to rotatably support a portion of both ends of the ejector, and a second supporter provided on the other side opposite the one side of the ice-making tray and having a second ejector support portion rotatably supporting a remaining portion of the both ends of the ejector.

The first supporter may include at least one first coupling hole, and the second supporter may include at least one second coupling hole formed at a position corresponding to the first coupling hole to be secured with the first supporter. The first supporter and the second supporter may be secured together by at least one screw.

The first supporter may include a cooling device fixing portion with the cooling device fixed to one side of the cooling device fixing portion.

The ice-making tray may include at least one ice-making cell configured to store ice-making water, and the first supporter may include at least one ice-making cell accommodating portion configured to accommodate the at least one ice-making cell.

The ice maker may further include an ice bucket configured to store ice produced in the ice-making tray, and the second supporter may further include a slider configured to guide the ice separated by the ejector from the ice-making tray to the ice bucket.

In accordance with another aspect of the present disclosure, an ice maker is provided. The ice maker includes a cooling device configured to provide cold air, an ice-making tray movably provided between a first position adjacent to the cooling device and a second position spaced farther from the cooling device than the first position, and an ejector configured to separate the ice produced in the ice-making tray, wherein the ice-making tray is configured to move to the first position when the ejector is rotated to a first angle and to the second position when the ejector is rotated to a second angle.

The ejector may include a driving portion formed at both ends and having an eccentric shape, and the ice-making tray may include a rotation guide portion that contacts a part of the driving portion.

The ice maker may further include a supporter configured to support the ice-making tray and rotatably fix the ejector, wherein the supporter may include a guide portion that contacts a part of the ice-making tray and guides movement of the ice-making tray.

In accordance with another aspect of the present disclosure, a refrigerator is provided. The refrigerator includes a main body having a storage compartment, and an ice maker provided in the storage compartment and configured to make ice, wherein the ice maker includes a cooling device configured to provide cold air, an ice-making tray movably provided between a first position adjacent to the cooling device and a second position spaced farther from the cooling device than the first position, and a supporter configured to support the ice-making tray, wherein the ice maker is operated in a first ice-making mode when the ice-making tray is in the first position and operated in a second ice-making mode having an ice-making speed slower than an ice-making speed of the first ice-making mode.

The refrigerator may further include an ejector configured to separate the ice produced in the ice-making tray and move the ice-making tray as it is rotated about the supporter.

The refrigerator may further include a driving source configured to rotate the ejector, and at least one processor configured to control the driving source, wherein the at least one processor is configured to control the driving source to rotate the ejector to a first angle when operating the ice maker in the first ice-making mode, and control the driving source to rotate the ejector to a second angle when operating the ice maker in the second ice-making mode.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, like reference numerals will be understood to refer to like parts, components, and structures.

DETAILED DESCRIPTION

Figure 1:
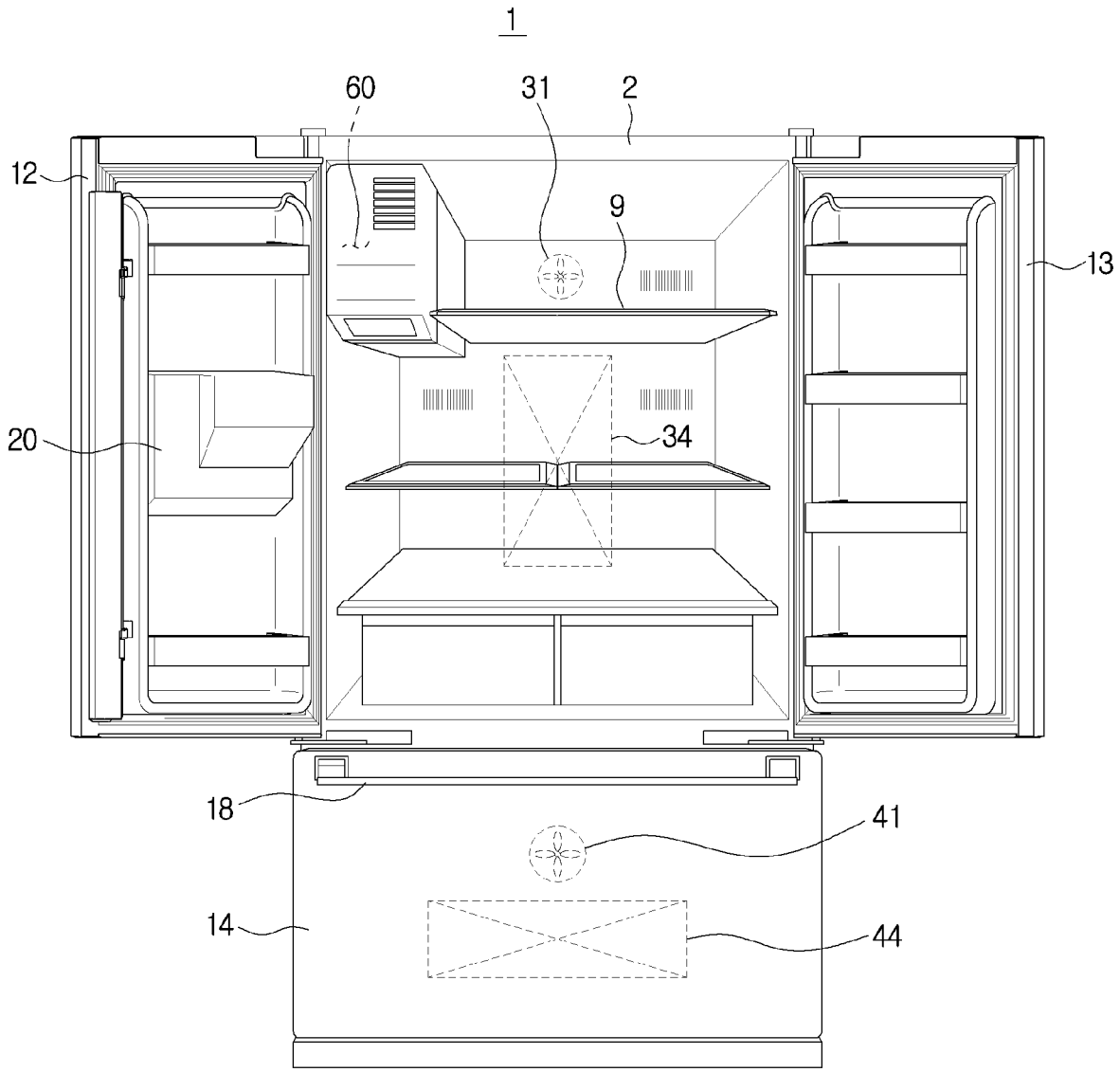
FIG. 1 is a view illustrating an appearance of a refrigerator according to an embodiment of the present disclosure.

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Configurations illustrated in various embodiments and the drawings described in the present specification are only various embodiments, and thus it is to be understood that various modified examples, which may replace or modify various embodiments described in the present specification, are possible.

Also, like reference numerals or symbols provided in the drawings of the present specification represent members or components that perform the substantially same functions.

It will be understood that the terms "includes," "comprises," "including," and/or "comprising," when used in this specification, specify the presence of stated features, figures, operations, components, or combination thereof, but do not preclude the presence or addition of one or more other features, figures, operations, components, members, or combinations thereof.

It will be understood that, although the terms first, second, etc. may be used herein to describe various components, these components should not be limited by these terms. These terms are only used to distinguish one component from another. For example, a first component could be termed a second component, and, similarly, a second component could be termed a first component, without departing from the scope of the present disclosure. As used herein, the term "and/or" includes any and all combinations of one or more of associated listed items.

The terms "front-end," "rear-end," "upper portion," "lower portion," "upper end," "lower end," and the like used in the below descriptions are defined based on the drawings, and shape and position of each component are not limited to the terms.

Hereinafter, various embodiments according to the present disclosure are described with reference to the accompanying drawings in detail.

FIG. 1 is a view illustrating an appearance of a refrigerator 1 according to an embodiment of the present disclosure.

Figure 2:
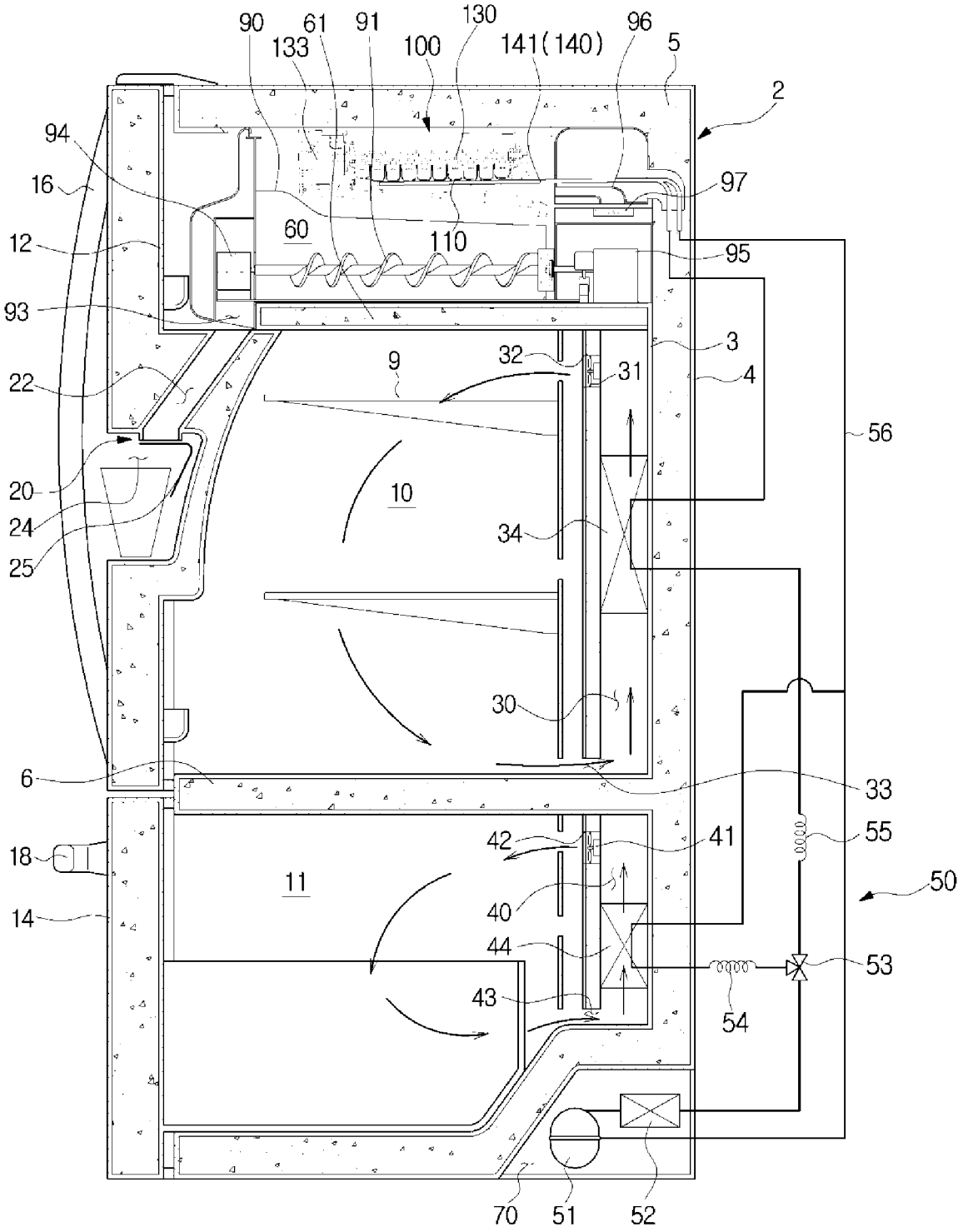
FIG. 2 is a schematic cross-sectional view illustrating the internal configuration of the refrigerator of FIG. 1 according to an embodiment of the present disclosure.

FIG. 2 is a schematic cross-sectional view illustrating the internal configuration of the refrigerator 1 of FIG. 1 according to an embodiment of the present disclosure.

Figure 3:
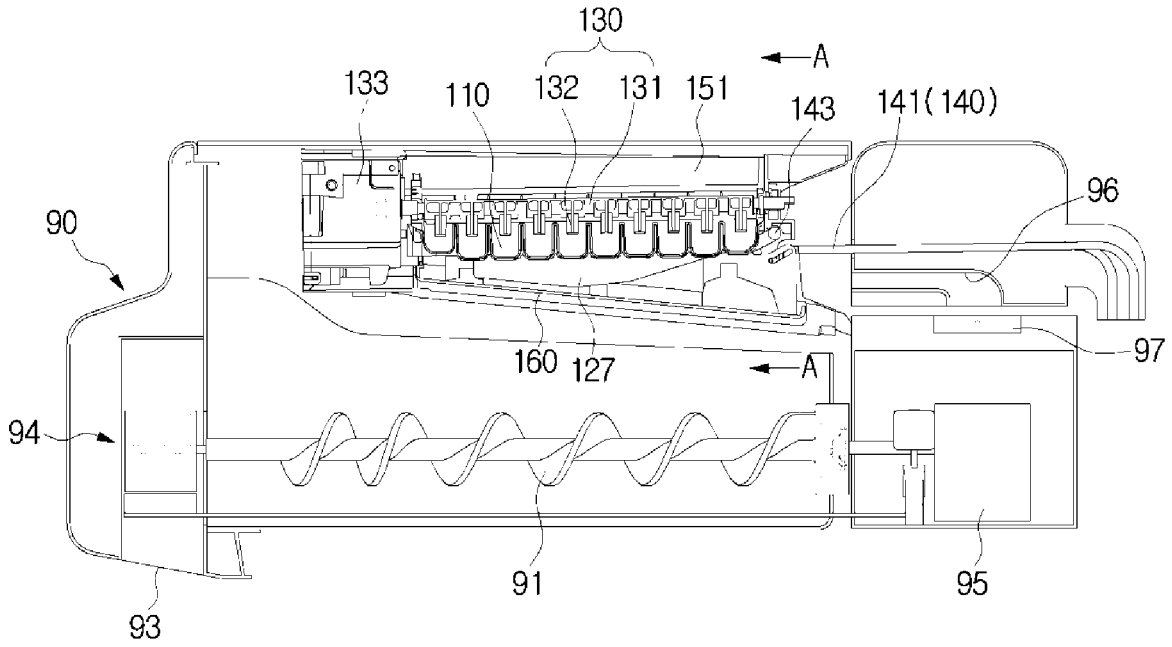
FIG. 3 is a schematic cross-sectional view illustrating an enlarged configuration of the ice making chamber of the refrigerator of FIG. 1 according to an embodiment of the present disclosure.

FIG. 3 is a schematic cross-sectional view illustrating an enlarged configuration of the ice making chamber 60 of the refrigerator 1 of FIG. 1 according to an embodiment of the present disclosure.

Referring to FIGS. 1, 2, and 3, the refrigerator 1 according to an embodiment of the present disclosure may include a main body 2, storage compartments 10 and 11 capable of refrigerating or freezing foods, an ice making chamber 60 separated by an ice making chamber wall 61 with the storage compartments 10 and 11, and a cooling system 50 for supplying cool air to the storage compartments 10 and 11 and ice making chamber 60.

The main body 2 may include an inner case 3 forming the storage compartments 10 and 11, an outer case 4 coupled to the outside of the inner case 3 to form an external appearance, a heat insulating material 5 foamed between the inner case 3 and the outer case 4.

The storage compartments 10 and 11 are formed to be open on the front side and may be partitioned into an upper chamber, a refrigerating chamber 10, and a lower chamber, a freezing chamber 11, by a horizontal partition 6. The horizontal partition 6 may include a heat insulating material for blocking heat exchange between the refrigerating chamber 10 and the freezing chamber 11.

A shelf 9 may be disposed in the refrigerating chamber 10 to place foods thereon and divide storage space into upper and lower ones. The open front of the refrigerating chamber 10 may be opened or closed by a pair of doors 12 and 13 pivotably hinged to the main body 2. Each of the doors 12 and 13 may be provided with a handle 16 for opening or closing the doors 12 and 13.

The door 12 may be provided with a dispenser 20 capable of taking out ice from the ice making chamber 60 from the outside without opening the door 12. The dispenser 20 may include a take-out space 24 through which ice may be taken out, a lever 25 for selecting whether or not to take out ice, a chute 22 for guiding the ice discharged through the ice discharge port 93 to the take-out space 24.

The open front of the freezing chamber 11 may be opened or closed by a sliding door 14 that may slide into the freezing chamber 11. On the rear side of the sliding door 14, a storage box 19 for storing food may be provided. The sliding door 14 may be provided with a handle 18 for opening or closing the sliding door 14.

The cooling system 50 may include a compressor 51 for compressing a refrigerant at high pressure, a condenser 52 for condensing the compressed refrigerant, an expansion device 54 and 55 that inflates the refrigerant at a low pressure, an evaporator 34, 44 that evaporates the refrigerant to produce cool air, a refrigerant pipe 56 for guiding the refrigerant.

The compressor 51 and the condenser 52 may be disposed in the machine room 70 provided at the lower rear portion of the main body 2. The evaporators 34 and 44 may be disposed in a refrigerating chamber cold air supplying duct 30 provided in the refrigerating chamber 10 and a freezing chamber cold air supplying duct 40 provided in the freezing chamber 11.

The refrigerating chamber cold air supplying duct 30 may include an inlet 33, a cold air outlet 32, and a blowing fan 31 to circulate the cold air in the refrigerating chamber 10. The freezing chamber cold air supplying duct 40 may include a suction port 43, a cold air discharge port 42 and a blowing fan 41 to circulate the cold air in the freezing chamber 11.

The refrigerant pipe 56 may be branched at one point to allow the refrigerant to flow into the freezing chamber 11 or into the refrigerating chamber 10 and the ice making chamber 60, and a switching valve 53 for switching the flow path of the refrigerant may be provided at the branch point.

A portion 140 of the refrigerant pipe 56 may be disposed inside the ice making chamber 60 to cool the ice making chamber 60. The portion 140 of the refrigerant pipe 56 disposed in the ice making chamber 60 may be disposed adjacent to the ice-making tray 110 and may directly supply cooling energy to the ice-making tray 110 in a thermal conduction manner.

Hereinafter, the portion 140 of the refrigerant pipe 56 disposed inside the ice making chamber 60 to contact the ice-making tray 110 is referred to as a cooling device 141. The liquid refrigerant that is in the low-temperature and low-pressure state after passing through the expansion device 55 may be evaporated into the gaseous state by absorbing heat inside the ice-making tray 110 and the ice making chamber 60 while circulating inside the cooling device 141. Accordingly, the cooling device 141 and the ice-making tray 110 may function as an evaporator in the ice making chamber 60.

The cooling system 50 has been described above, but the arrangement of the refrigerant pipe 56 of the cooling system 50 is not limited thereto and any arrangement may be employed as long as it allows supplying cold air to the refrigerating chamber 10, the freezing chamber 11 and the ice making chamber 60.

The ice maker 100 may include an ice-making tray 110 for storing ice-making water, an ejector 130 for separating ice from the ice-making tray 110, a driving source 133 for rotating the ejector 130, a drain duct 160 for collecting defrosted water from the ice-making tray 110 and guiding the flow of air inside the ice making chamber 60, an ice making chamber fan 97 for circulating air inside the ice making chamber 60.

An ice bucket 90 is disposed below the ice-making tray 110 to collect ice falling from the ice-making tray 110. The ice bucket 90 is provided with an auger 91 to transport the stored ice to the ice discharge port 93, an auger motor 95 to drive the auger 91, and a crushing device 94 to crush ice.

The auger motor 95 is disposed behind the ice making chamber 60 and the ice making chamber fan 97 may be disposed above the auger motor 95. A guide passage 96 to guide the air discharged from the ice making chamber fan 97 to the front of the ice making chamber 60 may be provided on top of the ice making chamber fan 97.

The air forced to flow by the ice making chamber fan 97 may be circulated in the ice making chamber 60 in the direction of the arrow shown in FIG. 3. That is, the air discharged up the ice making chamber fan 97 may flow between the ice-making tray 110 and the drain duct 160 through the guide passage 96. At this time, the air exchanges heat with the ice-making tray 110 and the cooling device 141, and the cooled air flows to the ice discharge port 93 of the ice bucket 90 and then be sucked into the ice making chamber fan 97 again.

Figure 4:
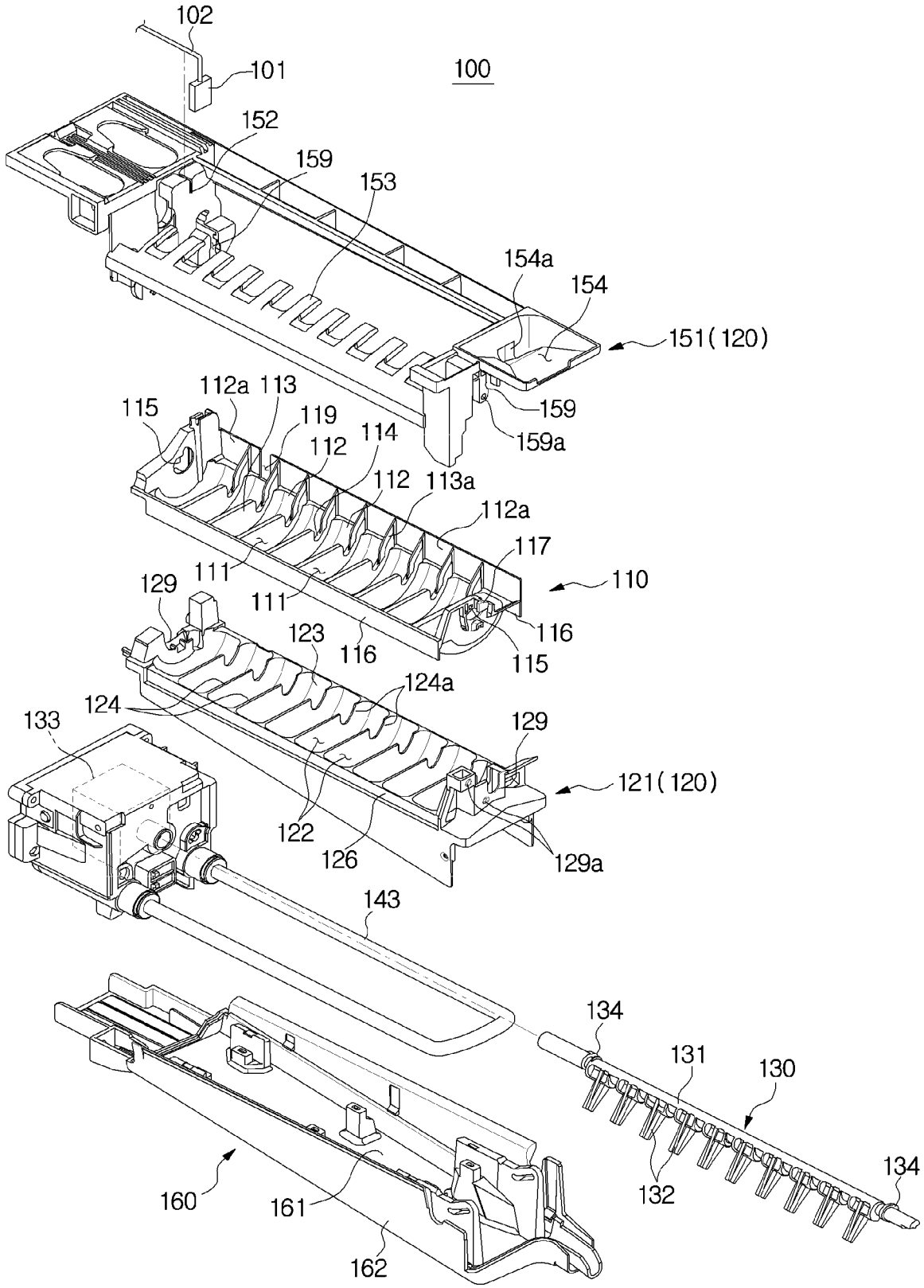
FIG. 4 is an exploded perspective view illustrating the ice maker of FIG. 2 according to an embodiment of the present disclosure.

FIG. 4 is an exploded perspective view illustrating the ice maker 100 of FIG. 2 according to an embodiment of the present disclosure.

Figure 5:
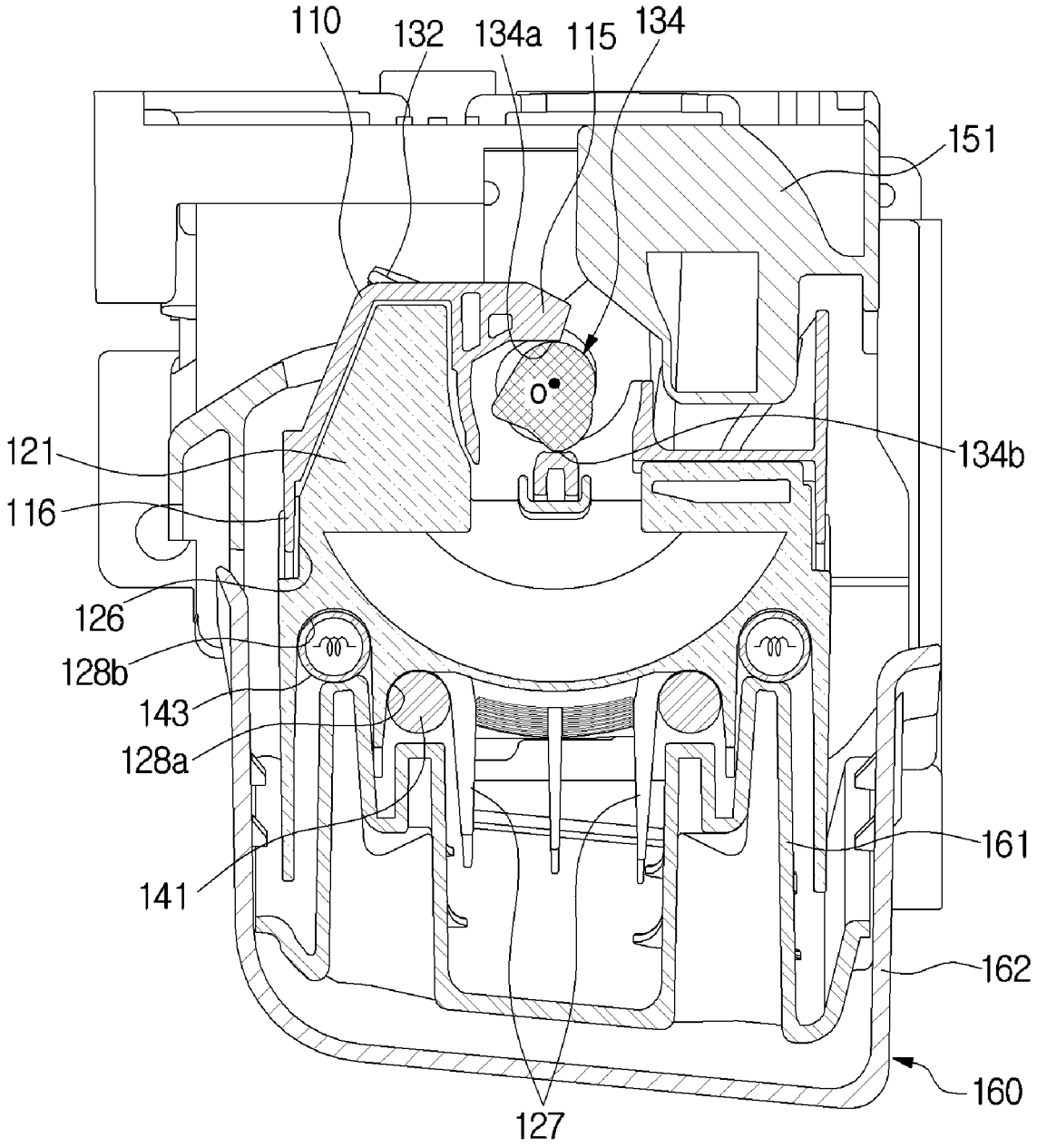
FIG. 5 is a cross-sectional view taken along the line A-A' shown in FIG. 3 in which the ice-making tray of FIG. 4 is disposed at the first position according to an embodiment of the present disclosure.

FIG. 5 is a cross-sectional view taken along the line A-A' shown in FIG. 3 in which the ice-making tray 110 of FIG. 4 is disposed at the first position according to an embodiment of the present disclosure.

Figure 6:
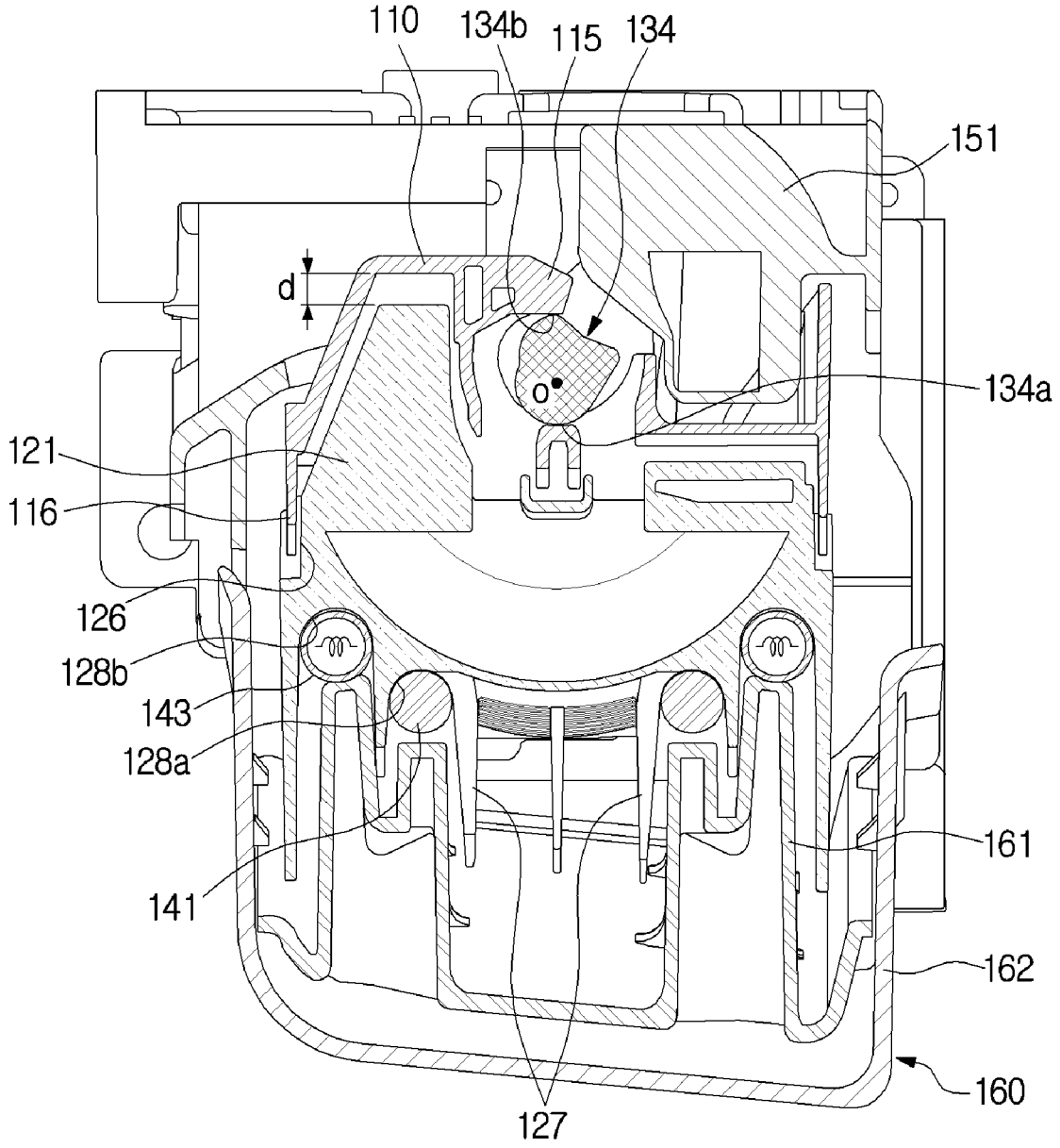
FIG. 6 is a cross-sectional view taken along the line A-A' shown in FIG. 3 in which the ice-making tray of FIG. 4 is disposed at the second position according to an embodiment of the present disclosure.

FIG. 6 is a cross-sectional view taken along the line A-A' shown in FIG. 3 in which the ice-making tray 110 of FIG. 4 is disposed at the second position according to an embodiment of the present disclosure.

Figure 7:
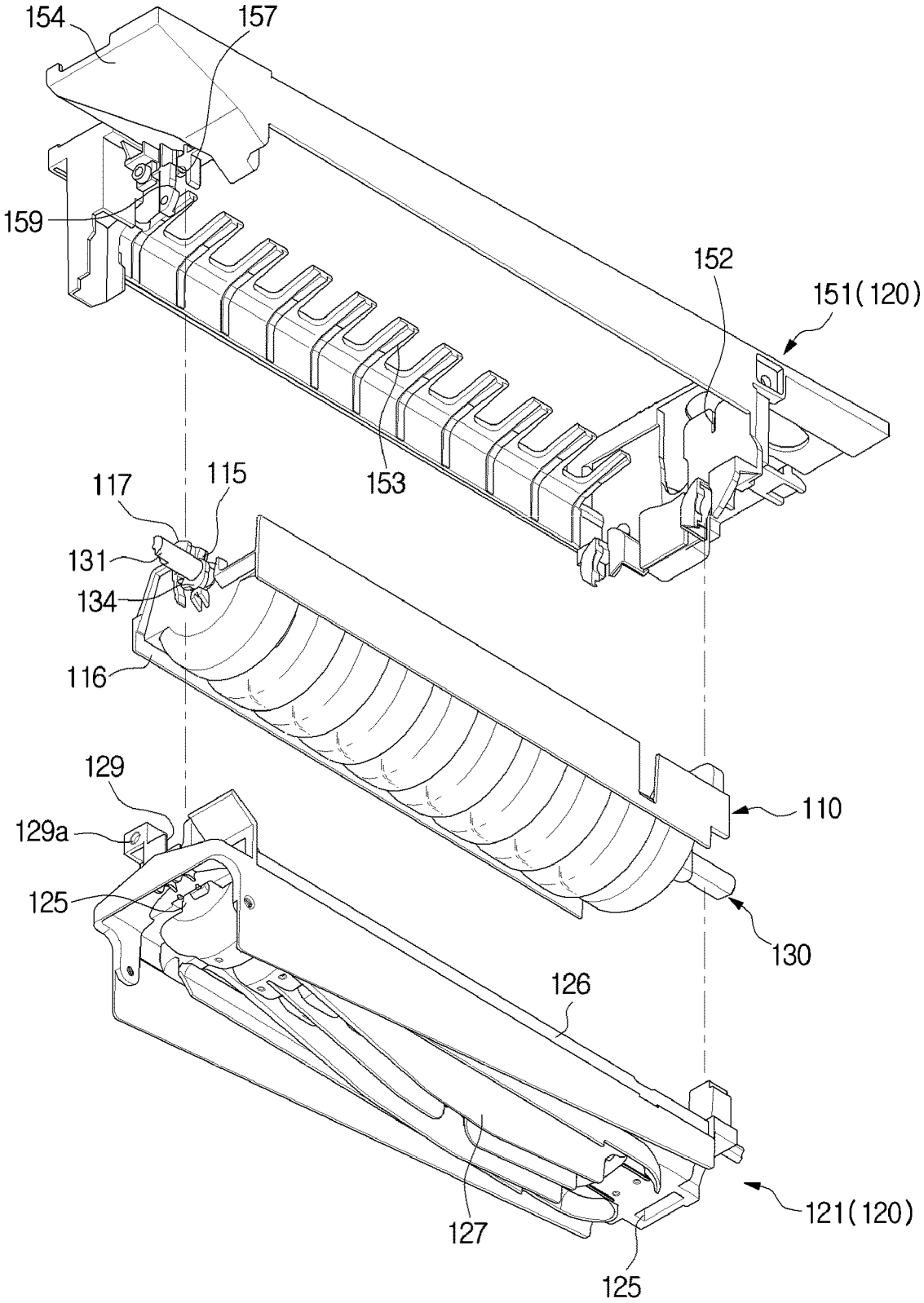
FIG. 7 shows disjointed ice-making tray, first supporter and second supporter of the ice maker of FIG. 4 viewed from below according to an embodiment of the present disclosure.

FIG. 7 shows disjointed ice-making tray 110, first supporter 121 and second supporter 151 of the ice maker of FIG. 4 viewed from below according to an embodiment of the present disclosure.

Figure 8:
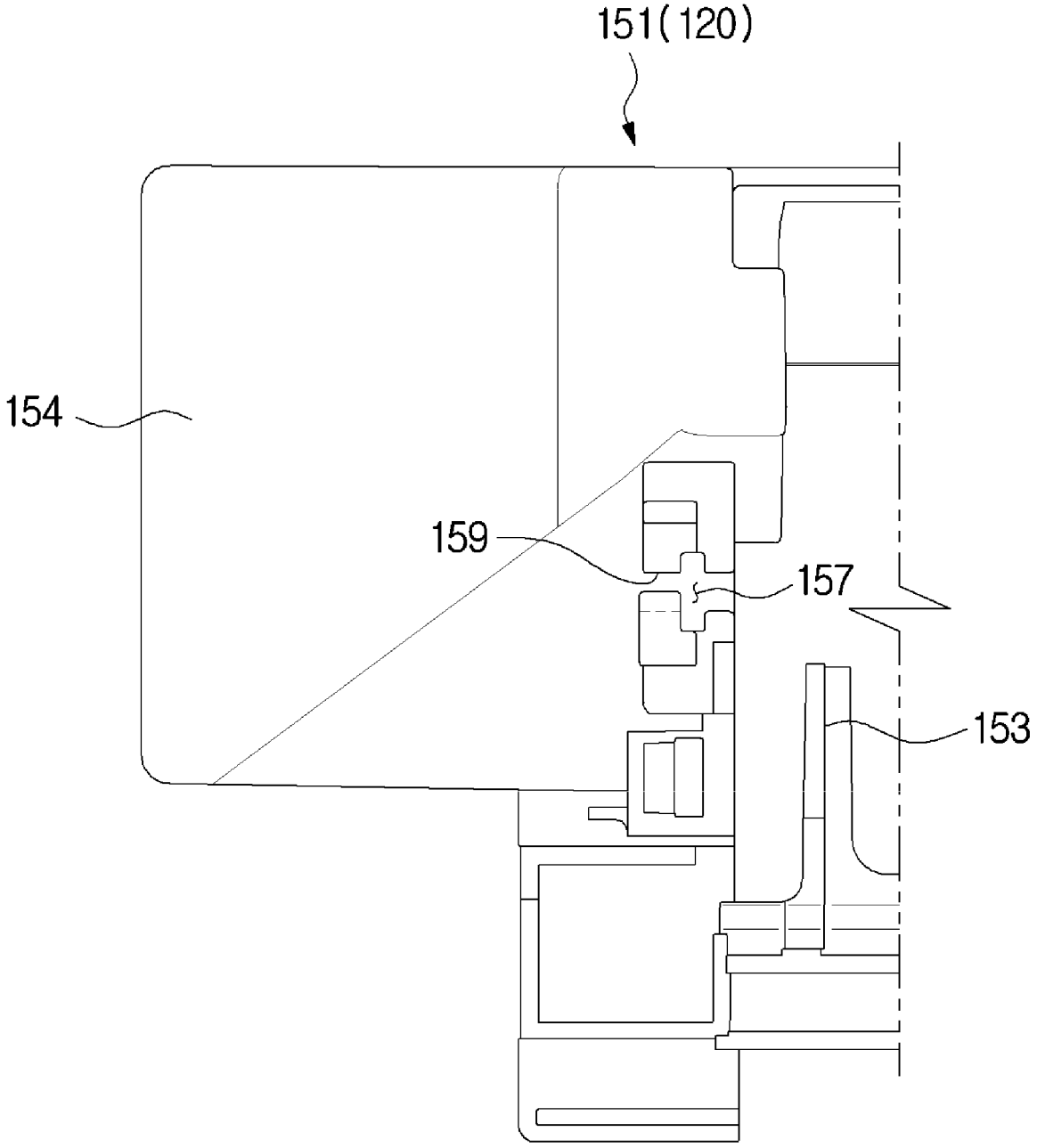
FIG. 8 is a plan view of the second supporter of FIG. 4 viewed from below according to an embodiment of the present disclosure.

FIG. 8 is a plan view of the first supporter 121 of FIG. 4 viewed from below according to an embodiment of the present disclosure.

Figure 9:
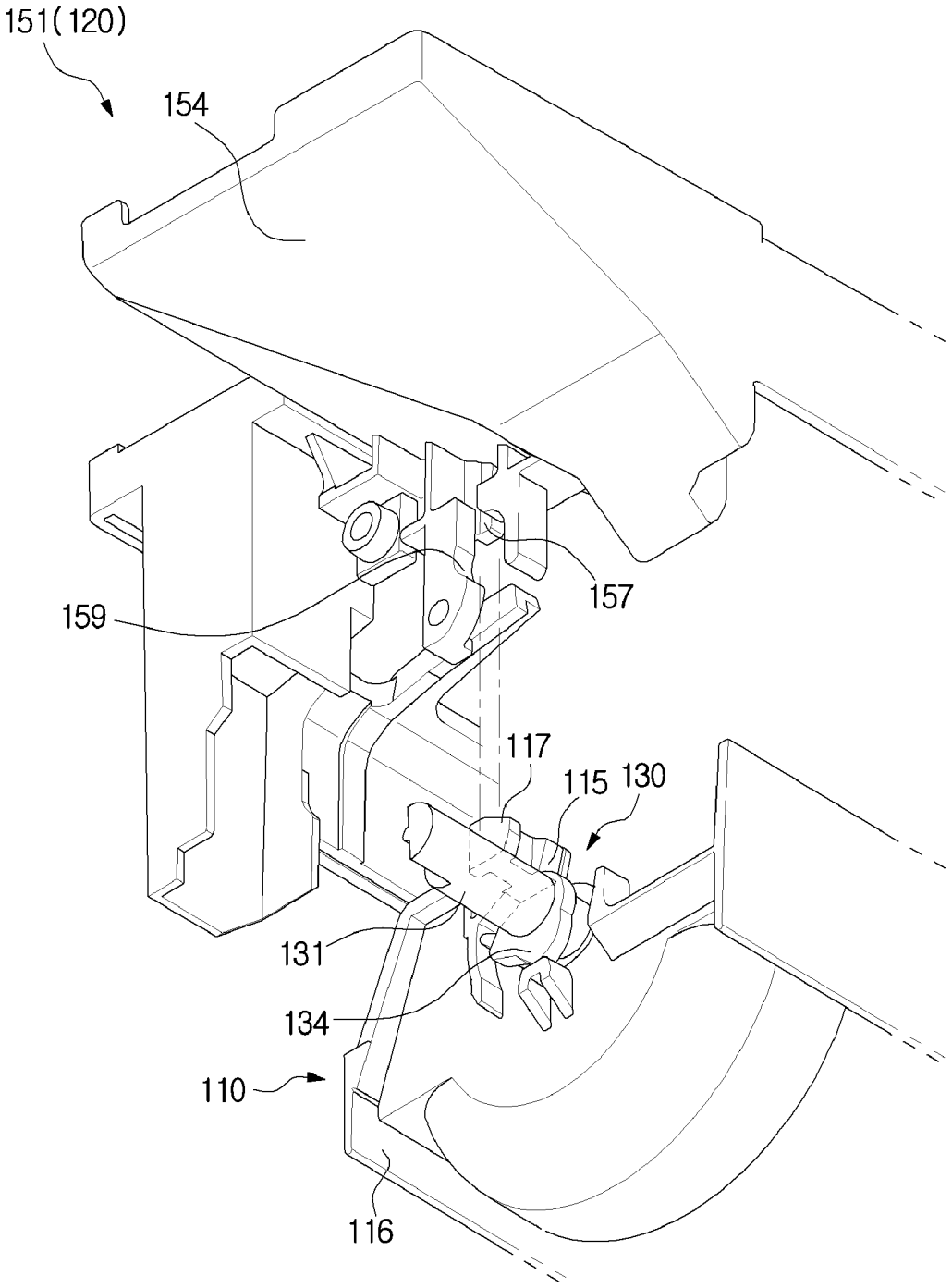
FIG. 9 is a view illustrating combination of a second tray guide part of FIG. 4 with a second supporter guide part according to an embodiment of the present disclosure.

FIG. 9 is a view illustrating combination of a second tray guide part 117 of FIG. 4 with a second supporter guide part 157 according to an embodiment of the present disclosure.

Figure 10:
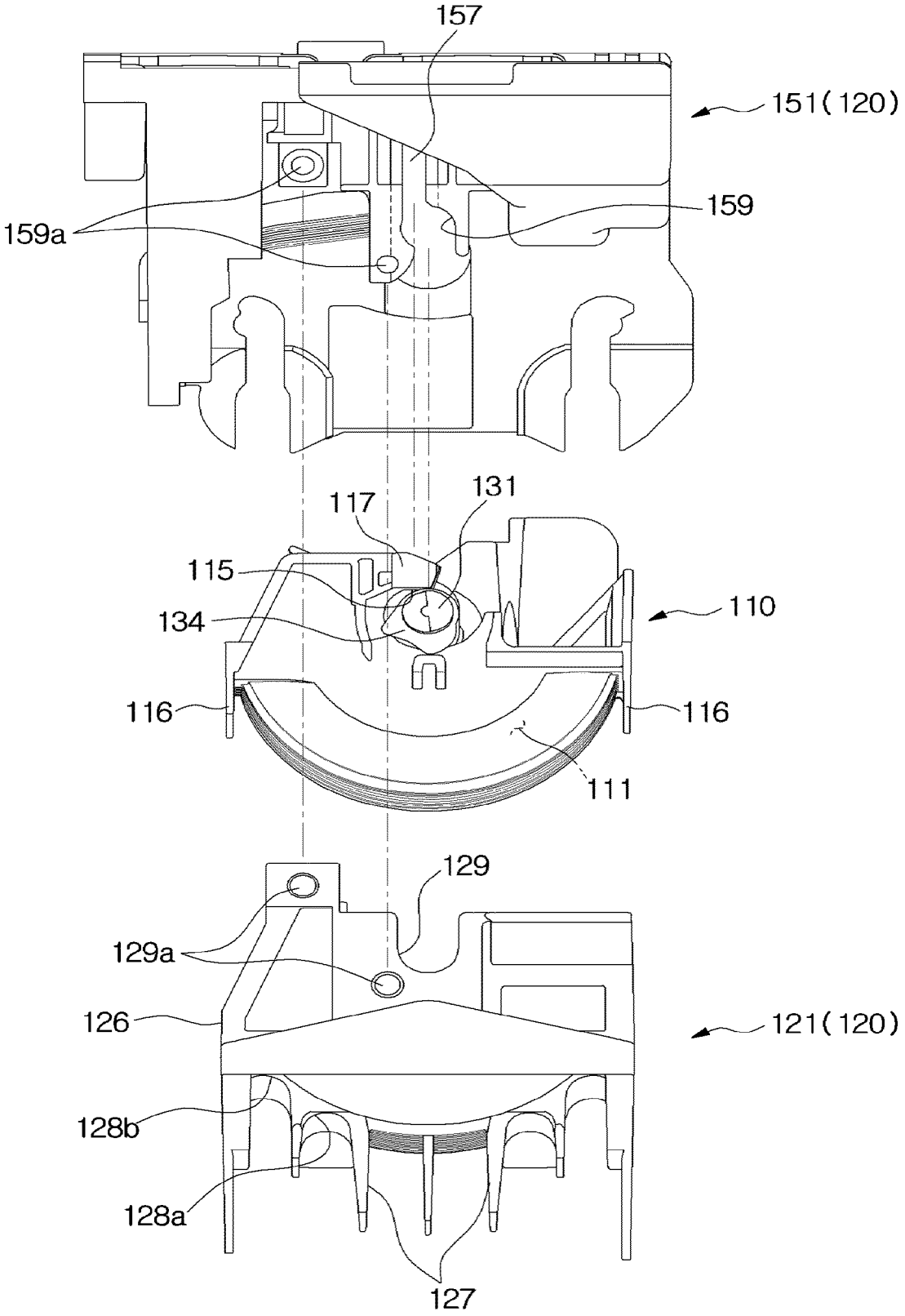
FIG. 10 is a view illustrating coupling relationships between the ice-making tray, an ejector, the first supporter and the second supporter of FIG. 4 according to an embodiment of the present disclosure.

FIG. 10 is a view illustrating coupling relationships between the ice-making tray 110, an ejector 130, the first supporter 121 and the second supporter 151 of FIG. 4 according to an embodiment of the present disclosure.

Referring to FIGS. 4, 5, 6, 7, 8, 9, and 10, the ice maker 100 according to an embodiment of the present disclosure may include an ice-making tray 110 having a space for forming ice, a supporter 120 for supporting the ice-making tray 110, an ejector 130 for separating ice from the ice-making tray 110, a cooling device 141 for providing cooling air to the ice-making tray 110.

The ice-making tray 110 is supported by a supporter 120 as will be described later, and may include one or more ice-making cells 111 for storing ice-making water. The ice-making tray 110 may be closely attached to the upper surface of the first supporter 121, which will be described later. The ice-making tray 110 may be coupled with the first supporter 121 by being simply placed on the upper surface of the first supporter 121.

The ice-making tray 110 may include the one or more ice-making cells 111 for storing ice-making water, a tray base portion 112 forming the one or more ice-making cells 111, a tray partition wall 113 separating the respective ice-making cells 111 from each other, a tray connecting part 114 for connecting the ice-making cells 111 so that water may be supplied to all the ice-making cells 111 when water is supplied.

The ice-making tray 110 may be formed of a material having a low thermal conductivity. For example, the ice-making tray 110 may be formed of a plastic material. The ice-making tray 110 may be formed of a material having a thermal conductivity lower than that of the first supporter 121, which will be described later.

The ice-making tray 110 may be integrally formed. Therefore, the ice maker 100 may be assembled easily by simply coupling the ice-making tray 110 to the upper surface of the first supporter 121 after the ice-making tray 110 is integrally formed.

If the ice making speed with the ice-making water is too fast, gases such as oxygen or carbon dioxide and other impurities, which are dissolved in the ice-making water, may not exit and cause a turbidity phenomenon that makes turbid ice.

Referring to FIGS. 5 and 6, in order to improve (or minimize) the turbidity phenomenon to form transparent ice, the ice-making tray 110 according to an embodiment of the present disclosure may be provided to be movable relative to the supporter 120. Specifically, the ice-making tray 110 may be provided to be movable between the first position adjacent to the cooling device 141 and a second position spaced farther from the cooling device 141 than the first position. The ice-making tray 110 may include a rotation guide portion 115 that allows a driving part 134 of the ejector 130, which will be described later, to be rotatably inserted thereto and guides rotation of the driving part 134.

The rotation guide portion 115 may be formed at both ends of the ice-making tray 110 in the longitudinal direction, and selectively arranged to be in contact with a part of the driving part 134 of the ejector 130. The driving part 134 may be slidingly rotated on one surface of the rotation guide portion 115, and with this structure, the ice-making tray 110 may be moved between the first position adjacent to the cooling device 141 and the second position spaced farther from the cooling device 141 than the first position. That is, since the ejector 130 is fixed to the supporter 120 in a rotatable state, the ice-making tray 110 may be moved relative to the supporter 120.

Specifically, the ice-making tray 110 may move to the first position adjacent to the cooling device 141 to quickly receive the cool air from the cooling device 141 when it is desired to rapidly form ice, and move to the second position, which is relatively farther from the cooling device 141 than the first position to receive the cool air relatively slowly from the cooling device 141 when it is desired to make transparent ice. The ice-making tray 110 and the first supporter 121 may be in contact with each other when the ice-making tray 110 is in the first position, and a distance d between the ice-making tray 110 and the first supporter 121 may be set to be as much as approximately 2 mm to 4 mm when the ice-making tray 110 is in the second position.

In other words, the ice maker 100 according to an embodiment of the present disclosure may operate in a first ice-making mode, in which the transparency of the ice is reduced but the ice formation time is shortened by rapidly receiving the cool air when the ice-making tray 110 is in the first position, and operate in a second ice making mode, in which the time for forming the ice increases but the transparency of the ice is improved by slowly receiving the cool air when the ice-making tray 110 is in the second position (due to the increased distance d between the ice-making tray 110 and the first supporter 121).

The ice-making tray 110 may include a first tray guide portion 116 provided at the lower end of both ends in the width direction for guiding the movement of the ice-making tray 110. The first tray guide portion 116 may extend in the longitudinal direction. The first tray guide portion 116 is engaged with the outer surface of the first supporter guide portion 126 of the first supporter 121 to guide the vertical movement of the ice-making tray 110. The first tray guide portion 116 may be provided to overlap the first supporter guide portion 126 to guide the movement of the ice-making tray 110.

Referring to FIGS. 7, 8, and 9, the ice-making tray 110 may include a second tray guide part 117 provided at one end of the longitudinal direction for guiding the movement of the ice-making tray 110. The second tray guide part 117 may extend to an extent of a predetermined length from one end of the ice-making tray 110 in the longitudinal direction and extend in both left and right directions to have a substantially T-shaped cross-section. The second tray guide part 117 may be inserted into the second supporter guide part 157 of the second supporter 151 to guide the vertical movement of the ice-making tray 110, which will be described later.

The ice-making tray 110 may include an escape avoidance wall 112*a* extending upward from one end in the width direction of the tray base portion 112 to guide the movement of ice when the ice is separated from the ice-making cells 111.

The ice-making tray 110 may include a cutting rib 113*a* that may cut links of ice generated in the ice-making cells 111 when the ice is separated from the ice-making cells 111. The cutting rib 113*a* may extend from the tray partition wall 113.

The ice-making tray 110 may include an overcharge water outlet 119 for discharging the overcharged water to the drain duct 160 when more water than a predetermined amount is supplied to the ice-making cells 111.

The supporter 120 may include a first supporter 121 for supporting a lower portion of the ice-making tray 110.

The first supporter 121 may contact the cooling device 141 to receive cooling energy from the cooling device 141 in a heat conduction manner. Since the first supporter 121 may be formed of a material having a relatively high thermal conductivity to transmit the cooling energy received from the cooling device 141 to the ice-making tray 110, it may efficiently perform the function of a heat exchanger for cooling the ice making chamber 60.

The first supporter 121 may include an ice-making cell receiving portion 122 formed to be concave to receive the ice-making cell 111 of the ice-making tray 110, and a first base portion 123 that forms the ice-making cell receiving portion 122.

The ice-making cell receiving portion 122 may have a shape corresponding to the ice-making cell 111 so as to receive the ice-making cell 111. The ice-making cell receiving portion 122 may be provided as many as the number of the ice-making cells 111. Each of the ice-making cell receiving portions 122 may be partitioned by the first partition wall 124. The first partition wall 124 may be provided with a first connecting portion 124*a* for connecting the ice-making cells 111.

Referring to FIG. 7, the first supporter 121 may include one or more drain holes 125 at both ends for preventing the water generated during the ice making process and the ice separating process from being collected and frozen. Specifically, the one or more drain holes 125 may be provided at a portion of the first supporter 121 corresponding to a portion where the driving part 134 of the ejector 130 is disposed. If water is collected and frozen in the portion where the driving part 134 of the first supporter 121 is disposed, the ejector 130 may not be rotated, and accordingly, the ejector 130 may not move the ice-making tray 110 in the vertical direction. Therefore, the first supporter 121 according to an embodiment of the present disclosure may be provided with the one or more drain holes 125 at a portion where the driving part 134 is disposed to prevent water from being collected and frozen.

At least one heat exchange rib 127 may protrude from the bottom of the first supporter 121 for promoting heat exchange between the first supporter 121 and the air in the ice making chamber 60 by expanding the heat transfer area with air in the ice making chamber 60.

Since the first supporter 121 according to an embodiment of the present disclosure is made of aluminum and may include the heat exchange rib 127 for increasing the heat transfer area with the air in the ice making chamber 60, the heat exchange efficiency of the air inside the first supporter 121 and the ice making chamber 60 may be improved and the inside of the ice making chamber 60 may be efficiently cooled and maintained in a cooled state.

A cooling device fixing portion 128*a* for accommodating the cooling device 141 is formed outside the lower portion of the first supporter 121. The cooling device fixing portion 128*a* may have the shape of a concave groove. The cooling device fixing portion 128*a* may be formed between the heat exchange ribs 127.

The cooling device 141 may be provided to have a substantially U-shape, and the cooling device fixing portion 128*a* of the first supporter 121 may also have a substantially U-shape to correspond to the cooling device 141.

The cooling device 141 may be received to be in contact with the cooling device fixing portion 128*a*.

In addition, an ice-separating heater 143 for providing heat to the ice-making tray 110 to easily separate ice may be provided outside the lower portion of the first supporter 121 when the ice is separated from the ice-making tray 110.

An ice-separating heater receiving portion 128*b* for accommodating the ice-separating heater 143 may be formed on the lower outside of the first supporter 121. The ice-separating heater receiving portion 128*b* may have the shape of a concave groove. The ice-separating heater receiving portion 128*b* may be formed between the heat exchange ribs 127.

The ice-separating heater 143 may be provided to have a substantially U-shape, and the ice-separating heater receiving portion 128*b* of the first supporter 121 may also have a substantially U-shape to correspond to the ice-separating heater 143. The ice-separating heater receiving portion 128*b* may be provided inside the cooling device fixing portion 128*a*.

The ice-separating heater 143 may be in contact with the ice-separating heater receiving portion 128*b*.

Referring to FIG. 9, the first supporter 121 may include a first ejector supporting portion 129 on which the ejector 130 is rotatably mounted. The first ejector supporting portion 129 may be provided at both end portions in the longitudinal direction of the first supporter 121 and may have a substantially U-shape. The first ejector supporting portion 129 may fix the ejector 130 to be rotatable with the second ejector supporting portion 159 of the second supporter 151 as will be described later. That is, the first ejector supporting portion 129 of the first supporter 121 and the second ejector supporting portion 159 of the second supporter 151 may form a substantially circular hole for supporting the rotation of the ejector 130 when the first supporter 121 and the second supporter 151 are engaged.

The first supporter 121 may include a first engaging hole 129*a* (e.g., a coupling hole) to be engaged with a second supporter 151 as will be described later. On or more of the first engaging hole 129*a* may be provided. The first supporter 121 and the second supporter 151 may be attached by being screwed together through the first engaging hole 129*a*.

The ejector 130 is provided to separate ice from the ice-making tray 110, and may be rotatably fixed to the supporter 120. The ejector 130 may include a rotating shaft 131, which is a center of rotation, and a blade 132 extending radially from the outer circumferential surface of the rotating shaft 131. According to this configuration, the ejector 130 may separate the ice formed in the ice-making cell 111 from the ice-making tray 110 as the rotating shaft 131 is rotated with respect to the ice-making tray 110.

The ejector 130 may be connected to the driving source 133 at one end of the rotating shaft 131, and rotated by rotational force received from the driving source 133. The driving source 133 may be a motor.

The ejector 130 may be provided at both ends of the ejector 130 and may include a driving part 134 that is slidingly rotated on one surface of the rotation guide portion 115 of the ice-making tray 110. The driving part 134 may be provided in a substantially eccentric shape. The driving part 134 may include a cam. The driving part 134 may include a first portion 134*a* adjacent to the rotating center O and a second portion 134*b* that is spaced farther from the rotating center O than the first portion 134*a* is.

Specifically, the ejector 130 may move the ice-making tray 110 to the first position adjacent to the cooling device 141 as shown in FIG. 5 when the rotating shaft 131 is rotated by the driving source 133 and the first portion 134*a* of the driving part 134 is in contact with the rotation guide portion 115, and move the ice-making tray 110 to the second position relatively distant from the cooling device 141 as shown in FIG. 6 when the second portion 134*b* is in contact with the rotation guide portion 115.

The ice maker 100 according to an embodiment of the present disclosure may move the ice-making tray 110 to the first position when rotating the ejector 130 at the first angle, and move the ice-making tray 110 to the second position when rotating the ejector 130 at the second angle. That is, the ice maker 100 according to an embodiment of the present disclosure may change the distance between the ice-making tray 110 and the cooling device 141 by rotating the ejector 130 at a specific angle.

According to this configuration, the ice maker 100 according to the present disclosure may rapidly form ice by rotating the ejector 130 to move the ice-making tray 110 to the first position when rapid ice-making is desired, and form transparent ice by rotating the ejector 130 to move the ice-making tray 110 to the second position when it is desired to make transparent ice. Accordingly, the ice maker 100 of the present disclosure may provide various ice-making modes with one ice maker.

The supporter 120 according to an embodiment of the present disclosure may further include a second supporter 151 for supporting the ice-making tray 110 from above. The second supporter 151 may support the movement of the ice-making tray 110 together with the first supporter 121.

The second supporter 151 may include a temperature sensor fixing portion 152 to which a wire 102 of a temperature sensor 101, which will be described later, is fixed. The temperature sensor fixing portion 152 may have a slit shape and may be formed at one end of the second supporter 151.

The second supporter 151 may include a slider 153 for guiding the ice ejected by the ejector 130 from the ice-making tray 110 to the ice bucket 90. The slider 153 may be provided at one end in the width direction of the second supporter 151 and may extend in the length direction of the second supporter 151. The slider 153 may be integrally formed with the second supporter 151 or formed separately from the second supporter 151 and then coupled to the second supporter 151.

The second supporter 151 may include a water supply portion 154 provided at one end portion along the longitudinal direction to receive water. The water supply portion 154 may include a water supply port 154*a* connected to the ice-making tray 110.

Referring to FIGS. 7, 8, and 9, the second supporter 151 may include a second supporter guide part 157 for guiding the movement of the ice-making tray 110 when the second tray guide part 117 of the ice-making tray 110 is inserted to the second supporter guide part 157 as described above. The second supporter guide part 157 may be formed to have substantially the same shape as that of the second tray guide part 117, so that the second tray guide part 117 may be inserted to fix the position of the ice-making tray 110 in a direction other than the vertical direction. In the present embodiment, since the cross section of the second tray guide part 117 has a substantially T shape, the second supporter guide part 157 may have a shape in which a substantially T-shaped hole extends in the vertical direction.

The second supporter 151 may include a second ejector supporting portion 159 for supporting the rotating shaft 131 of the ejector 130 together with the first ejector supporting portion 129 of the first supporter 121 as described above. The second ejector supporting portion 159 may rotatably support the rotating shaft 131 of the ejector 130 from above. When the first supporter 121 and the second supporter 151 are coupled to each other, the second ejector supporting portion 159 may form a substantially circular hole together with the first ejector supporting portion 129.

The second supporter 151 may include one or more second coupling holes 159*a* to be engaged with the first supporter 121 as described above. A plurality of the second coupling holes 159*a* may be provided. The first supporter 121 and the second supporter 151 may be screwed together through the one or more second coupling holes 159*a*.

The ice maker 100 according to an embodiment of the present disclosure may include a drain duct 160 for collecting defrosted water from the ice-making tray 110 and guiding the flow of air inside the ice making chamber 60.

The drain duct 160 is provided below the first supporter 121 to collect the defrosted water dropped from the first supporter 121 or the cooling device 141. A cool air flow path may be formed between the first supporter 121 and the drain duct 160.

The drain duct 160 may include a drain pan 161 for collecting the defrosted water and an anti-frost cover 162 provided to cover the lower portion of the drain pan 161 to prevent freezing of the drain pan 161.

The drain duct 160 may be arranged to be inclined so that the collected water flows toward the drain port.

The ice maker 100 according to an embodiment of the present disclosure may further include a temperature sensor 101 provided at one end of the ice-making tray 110 to measure a temperature inside the ice-making tray 110. The temperature sensor 101 may measure the temperature of water or ice contained in the nearest ice-making cell of the ice-making cells 111 to the one end of the ice-making tray 110 in the longitudinal direction. The temperature sensor 101 may transmit the measured temperature to a controller 172 (e.g., at least one processor) as will be described later. If the temperature measured by the temperature sensor 101 is lower than a predetermined temperature, the controller 172 may determine that the ice has been formed and control the driving source 133 of the ejector 130 to automatically separate the ice from the ice-making tray 110.

Figure 11:
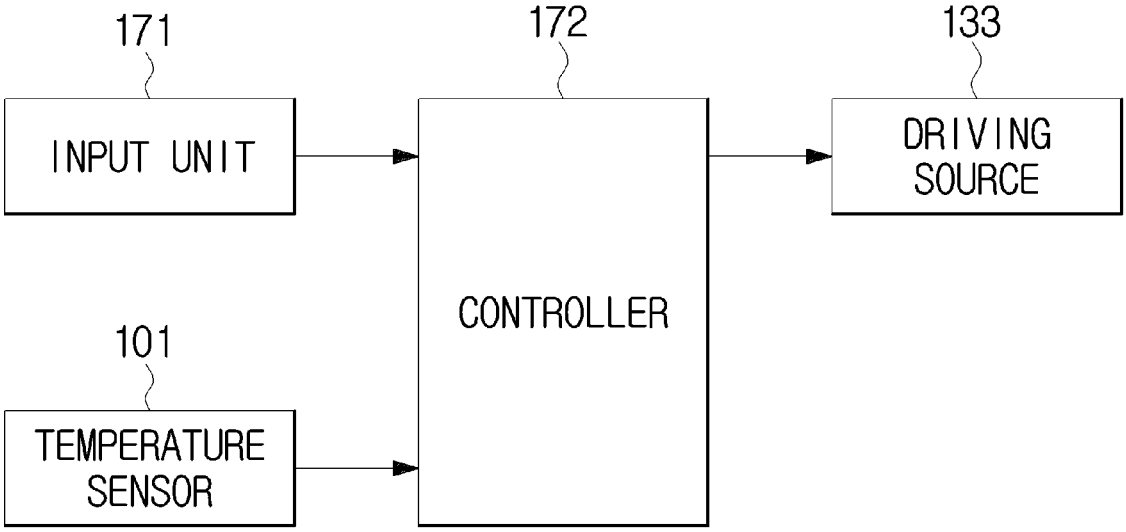
FIG. 11 is a block diagram of a method for controlling the ice maker of FIG. 2 according to an embodiment of the present disclosure.

FIG. 11 is a block diagram of a method for controlling the ice maker of FIG. 2 according to an embodiment of the present disclosure.

Referring to FIG. 11, the ice maker 100 according to an embodiment of the present disclosure may allow the user to input a command to operate in the first ice-making mode through an input unit 171 (e.g., an input device) to perform quick ice-making. The input unit 171 may send the command to the controller 172, and the controller 172 may control the driving source 133 of the ejector 130 to rotate the driving part 134. Accordingly, the ice-making tray 110 may move to the first position adjacent to the cooling device 141 as shown in FIG. 5. Since the ice-making tray 110 is adjacent to the cooling device 141 at the first position, it is possible to quickly receive cold air generated by the cooling device 141, thereby quickly forming ice.

Meanwhile, the ice maker 100 according to an embodiment of the present disclosure may allow the user to input a command to operate in the second ice-making mode through the input unit 171 to form transparent ice. The input unit 171 may send the command to the controller 172, and the controller 172 may control the driving source 133 of the ejector 130 to rotate the driving part 134. Accordingly, as shown in FIG. 6, the ice-making tray 110 may move to the second position spaced farther apart from the cooling device 141 than the first position. Since the ice-making tray 110 is more distant from the cooling device 141 at the second position, it is possible to receive the cool air relatively slowly from the cooling device 141, thereby slowly forming ice but forming transparent ice.

As described above, the ice-making tray 110 may be located at the first position or the second position, but the position of the ice-making tray 110 is not limited to these two positions. For example, rotation angle of the ejector 130 may be controlled more precisely to form ice with more various degrees of transparency according to the user's request.

According to the present disclosure, the ice maker and the refrigerator having the same may adjust the ice making speed by changing a distance between the ice-making tray and the cooling device.

According to the present disclosure, the ice maker and the refrigerator having the same may quickly produce opaque ice or slowly produce transparent ice according to the user's selection.

According to the present disclosure, the ice maker and the refrigerator having the same may move the ice-making tray using existing elements, thereby reducing material costs.

Since the ice maker and the refrigerator having the same use the ice maker mechanism according to the related art, the stability of the technology may be secured.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. A refrigerator comprising:

a main body having a storage compartment; and an ice maker provided in the storage compartment for making ice, wherein the ice maker comprises:

a cooling device for providing cool air, an ice-making tray movably arranged between a first position adjacent to the cooling device and a second position spaced farther from the cooling device than the first position, the ice-making tray configured to form ice at a first rate when at the first position and configured to form ice at a second rate when at the second position, and an ejector for moving the ice-making tray, the ejector includes a driver to separate ice produced in the ice-making tray.

2. The refrigerator of claim 1, wherein, when the ice-making tray is in the first position, the ice maker is operated in a first ice-making mode, wherein, when the ice-making tray is in the second position, the ice maker is operated in a second ice-making mode, and wherein the first rate is faster than the second rate.

3. The refrigerator of claim 1, wherein the ice-making tray includes a rotation guide portion that is in contact with the driver, and wherein the driver is configured to be slidingly rotated on one surface of the rotation guide portion.

4. The refrigerator of claim 3, wherein the driver is provided at both end portions of the ejector, and wherein the driver includes an eccentric shape.

5. The refrigerator of claim 4, wherein, when the driver is rotated a first angle such that a first portion adjacent to the rotation center is in contact with the rotation guide portion, the driver moves the ice-making tray to the first position adjacent to the cooling device, and wherein, when the driver is rotated a second angle such that a second portion spaced from the rotation center is in contact with the rotation guide portion, the driver moves the ice-making tray to a second position spaced apart from the cooling device.

6. The refrigerator of claim 1, further comprising:

a supporter for supporting the ice-making tray, and for rotatably fixing the ejector.

7. The refrigerator of claim 6, further comprising:

a temperature sensor provided to measure an inside temperature of the ice-making tray, wherein the supporter includes a temperature sensor fixing portion to fix the temperature sensor.

8. The refrigerator of claim 6, wherein the supporter includes a drain hole formed in a portion where the driver is disposed.

9. The refrigerator of claim 6, wherein the supporter includes a guide portion for guiding movement of the ice-making tray.

10. The refrigerator of claim 6, wherein the supporter comprises:

a first supporter provided on one side of the ice-making tray and having a first ejector support portion to rotatably support a portion of each end of the ejector; and a second supporter provided on the other side opposite the one side of the ice-making tray and having a second ejector support portion rotatably supporting a remaining portion of each end of the ejector.

11. The refrigerator of claim 10, wherein the first supporter includes at least one first coupling hole, and wherein the second supporter includes at least one second coupling hole formed at a position corresponding to the first coupling hole to be secured with the first supporter.

12. The refrigerator of claim 10, wherein the first supporter includes a cooling device fixing portion, and wherein the cooling device is fixed to one side of the cooling device fixing portion.

13. The refrigerator of claim 10, wherein the ice-making tray includes one ice-making cell for storing ice-making water, and wherein the first supporter includes at least one ice-making cell accommodating portion for accommodating the at least one ice-making cell.

14. The refrigerator of claim 10, wherein the ice maker further includes an ice bucket for storing ice produced in the ice-making tray, and wherein the second supporter further includes a slider for guiding the ice separated by the ejector from the ice-making tray to the ice bucket.

15. An ice maker comprising:

a cooling device for providing cool air;

an ice-making tray movably arranged between a first position adjacent to the cooling device and a second position spaced farther from the cooling device than the first position, the ice-making tray configured to form ice at a first rate when at the first position and configured to form ice at a second rate when at the second position, and an ejector configured to separate the ice produced in the ice-making tray, wherein the ice-making tray is configured to move to the first position when the ejector is rotated at a first angle and to the second position when the ejector is rotated at a second angle.

16. The ice maker of claim 15, wherein the ejector includes a driver formed at both ends and having an eccentric shape, and wherein the ice-making tray includes a rotation guide portion that contacts a part of the driver.

17. The ice maker of claim 15, further comprising:

a supporter for supporting the ice-making tray, and for rotatably fixing the ejector, wherein the supporter includes a guide portion that contacts a part of the ice-making tray and guides movement of the ice-making tray.

18. A refrigerator comprising:

a main body having a storage compartment; and an ice maker provided in the storage compartment for making ice;

wherein the ice maker comprises:

a cooling device for providing cool air, an ice-making tray movably provided between a first position adjacent to the cooling device and a second position spaced farther from the cooling device than the first position, the ice-making tray configured to form ice at a first rate when at the first position and configured to form ice at a second rate when at the second position, and a supporter for supporting the ice-making tray, wherein the ice maker is operated in:

a first ice-making mode when the ice-making tray is in the first position, and a second ice-making mode when the ice-making tray is in the second position, and wherein an ice-making speed of the second ice-making mode is slower than an ice-making speed of the first ice-making mode.

19. The refrigerator of claim 18, further comprising:

an ejector configured to:

separate the ice produced in the ice-making tray, and move the ice-making tray as it is rotated about the supporter.

20. The refrigerator of claim 19, further comprising:

a motor for rotating the ejector; and at least one processor configured to control the driving source, wherein the at least one processor is configured to:

control the motor to rotate the ejector to a first angle when operating the ice maker in the first ice-making mode, and control the motor to rotate the ejector to a second angle when operating the ice maker in the second ice-making mode.

* * * * *